US011735104B2

(12) United States Patent
Ha et al.

(10) Patent No.: US 11,735,104 B2
(45) Date of Patent: Aug. 22, 2023

(54) ELECTRONIC DISPLAY BOARD FOR CONTROLLING 4 WAY DUAL SCANNING IN WHICH GRAY SCALE PIXEL (GSP) IS APPLIED TO DYNAMIC IMAGE CORRECTION TECHNOLOGY (DICT)

(71) Applicant: DONG BANG DATA TECHNOLOGY CO., LTD., Seoul (KR)

(72) Inventors: Young-Jae Ha, Seoul (KR); Deok Sook Won, Anyang-si (KR); Seok Moo Jung, Bucheon-si (KR); Ok Jun Jang, Seoul (KR); Hyun Jun Ha, Anyang-si (KR); Byung Yun Jin, Seoul (KR)

(73) Assignee: DONG BANG DATA TECHNOLOGY CO., LTD., Seoul (KR)

( * ) Notice: Subject to any disclaimer, the term of this patent is extended or adjusted under 35 U.S.C. 154(b) by 0 days.

(21) Appl. No.: 17/766,820

(22) PCT Filed: Oct. 26, 2020

(86) PCT No.: PCT/KR2020/014642
§ 371 (c)(1),
(2) Date: Apr. 6, 2022

(87) PCT Pub. No.: WO2021/080395
PCT Pub. Date: Apr. 29, 2021

(65) Prior Publication Data

US 2023/0186830 A1 Jun. 15, 2023

(30) Foreign Application Priority Data

Oct. 25, 2019 (KR) ..... 10-2019-0133817

(51) Int. Cl.
*G09G 3/32* (2016.01)

(52) U.S. Cl.
CPC ..... *G09G 3/32* (2013.01); *G09G 2320/0233* (2013.01); *G09G 2320/0247* (2013.01); *G09G 2340/04* (2013.01)

(58) Field of Classification Search
CPC ..... G09G 2320/0233
See application file for complete search history.

(56) References Cited

FOREIGN PATENT DOCUMENTS

KR 10-1176891 B1 8/2012
KR 10-1624085 B1 6/2016
(Continued)

OTHER PUBLICATIONS

Machine translations of KR102015644B1 (Year: 2023).*
Machine translation of KR102015644B1 (Year: 2023).*

*Primary Examiner* — Gustavo Polo
(74) *Attorney, Agent, or Firm* — NKL Law; Jae Youn Kim

(57) ABSTRACT

An electronic display board is configured to control 4-way dual scanning in which a gray scale pixel (GSP) is applied to a DICT, wherein an MCU, which is equipped with a GSP function along with driving control and DICT control for easily implementing a high-definition image, can switch, by dual scanning, an image in which an image data value with a gamma value determined on a histogram by (a gamma controller) of an image processing DICT unit including a GSP has been gray-scaled by the GSP to equalize and process the image through gamma correction of the image and the histogram of the brightness of the image, so that the image can be displayed on the electronic display board without noises such as interruption of the image and distortion of the image quality even under the control of image transmission for high-speed processing.

3 Claims, 7 Drawing Sheets

(56) References Cited

FOREIGN PATENT DOCUMENTS

| | | | |
|---|---|---|---|
| KR | 10-2017-0123392 | A | 11/2017 |
| KR | 10-2018-0050125 | A | 5/2018 |
| KR | 10-2015644 | B1 | 8/2019 |

* cited by examiner

ELECTRONIC DISPLAY BOARD FOR CONTROLLING 4 WAY DUAL SCANNING IN WHICH GRAY SCALE PIXEL (GSP) IS APPLIED TO DYNAMIC IMAGE CORRECTION TECHNOLOGY (DICT)

TECHNICAL FIELD

The present invention relates to an LED electronic display board, and more particularly, to a module array multi scanning control that enables to display a high-definition image through a 4-way control technique. The present invention also relates to an electronic display board for controlling 4-way dual scanning in which a gray scale pixel (GSP) is applied to a dynamic image correction technology (DICT), wherein an image display dot of an LED module is processed in a 4-way format by an automatic image switching device using the control of an image display for image switching by an SCU to display a high-definition image through a 4-way control technique for each of image dot (RGB) pixels in the form of data configuration and processing of the LED module enabling various image displays so that an image quality with a sharper and higher resolution can be implemented and displayed by controlling a pixel display dot of the LED module.

BACKGROUND ART

A light-emitting diode (LED) refers to a semiconductor device that emits light, and is widely used in electronic display panels such as various kinds of electronic products and dashboards in various colors such as red, green, blue, and yellow.

Among them, an LED electronic display board includes a plurality of LEDs arranged in a matrix form to form pixels for displaying an image to enable the image to be displayed thereon. The LED electronic display board is installed in various forms at the outside or inside of a building so as to transmit advertisements or various kinds of information.

Generally, it is known that an electronic display board system displays information such as various characters or pictures by arranging an LED or a small fluorescent tube in a matrix form.

The electronic display board system receives an image signal from an AV apparatus such as a DVD, a VCR, broadcasting equipment or the like, and converts the image signal into a signal suitable for an electronic display board to allow an image to be displayed on the electronic display board. An electronic display board system is provided to display an image by converting an image signal into a signal suitable for an electronic display board.

In general, a module driver functions to display an image on the electronic display board with a one-to-one (1:1) configuration between a display image of an LED module and a dot (RGB). Although an image being transmitted is an ultra-high-definition image such as a UHD, an input image of the electronic display board is required to be driven to fit a screen of a display image of the electronic display board. Thus, it is required to reduce the resolution of the image of the electronic display board and perform various types of processes of changing the input image of the electronic display board to fit an input signal according to the size of the electronic display board.

Accordingly, high definition is also required in an image of the electronic display board such as the resolution of an image display board requiring high definition or the number of image processing bits requiring the resolution of a high pixel number, the processing speed of an image display frame, and the color sharpness in a high brightness image processing process. There is therefore a need for a control technique that can overcome the limitation of the transmission speed of the display image and the display size of the electronic display board in a display method of the electronic display board in order to display a high definition image of a UHD level or higher on the electronic display board, minimize a change in an image when displaying an LED dot (RGB) image on the electronic display board in order to implement an ultra-high-definition image, and enable to display a noise-free high definition image as it is even without any editing and correction process of the input image.

In other words, generally, a display driving operation is performed to allow an ultra-high-definition input image of the UHD level to fit a display resolution and a display image screen of the electronic display board. In order to display a high-brightness and high-efficiency image such as an ultra-high-definition image, an image driving circuit is implemented to display the image at the increased transmission speed of image data. However, even if the electronic display board includes an image processing circuit IC with a high-speed data transmission function, the control of various functions of the electronic display board is prone to encounter image noise phenomena such as interruption of the image or distortion of display image quality in the display of a high-definition image along with a flicker phenomenon of unexpected various image noises.

DISCLOSURE OF INVENTION

Technical Problem

The present invention has been made to solve the above-mentioned problems occurring in the prior art, and it is an object of the present invention to provide an electronic display board for controlling 4-way dual scanning in which a gray scale pixel (GSP) is applied to a DICT, wherein an MCU, which is equipped with a GSP function along with driving control and DICT control for easily implementing a high-definition image, can switch, by dual scanning, an image in which an image data value with a gamma value determined on a histogram by an image processing DICT unit including a GSP has been gray-scaled by the GSP to equalize and process the image through gamma correction of the image and the histogram of the brightness of the image, so that the image can be displayed on the electronic display board without noises such as interruption of the image and distortion of the image quality even under the control of image transmission for high-speed processing.

Technical Solution

To accomplish the above object, the present invention provides an electronic display board for controlling 4-way dual scanning in which a GSP is applied to a DICT, including: an image signal source that is a source for supplying an image signal to be displayed on an LED electronic display board module, the image signal source being configured to play a video medium such as a DVD, an HDML, a DP or a VCR or fetch image data stored in a memory and transmit the image data to the LED electronic display board module; an main control unit (MCU) configured to switch and display, by dual scanning, an image in which an image data value with a gamma value determined on a histogram by a gamma controller of an image processing DICT unit including a gray scale processor (GSP) has been gray-scaled by the GSP for the purpose of 4-way high-resolution transmission of input image data of the image signal source to enable a high-definition display without any change in the data transmission speed or the number of image frames and equalize and process the image through gamma correction of the image and the histogram of the brightness of the image, so that image data with no noise can be provided by controlling phenomena such as interruption of the image and distortion of the image quality occurring when transmitting a high-definition image signal according to a flicker phenomenon during the display of the image, and thus the image can be displayed on the electronic display board without any noises; a server control unit (SCU) configured to control an auto flicker detection unit to generate a display image through a reduction in flicker noise by a dot output value and a gray scale control value of an LED module of an image output section, to control a signal designated by an integration time setting unit (ITS) to be switched to image data as image display data in response to the image data applied thereto after switching, by dual scanning, an image in which an image data value with the gamma value determined on the histogram by the image processing DICT unit of the MCU 200 has been gray-scaled by the GSP, and to control the switched image data to be scanned onto pixel dots in a multi 4-way format through the driving of a module driver to display an image on an LED electronic display board module so as to allow a high-definition image to be displayed on the electronic display board; an LED electronic display board module configured to form a screen by arranging, in a matrix form, a unit display module in which a plurality of LEDs are arranged for each of n×m dot (RGB) pixels in the form of a module array, and to allow the switched image data scanned onto pixel dots through the driving of a module driver in response to the image signal inputted through the image signal source to be displayed thereon in a multi 4-way format.

Advantageous Effects

As described above, the electronic display board for controlling 4-way dual scanning in which a GSP is applied to a DICT according to an embodiment of the present invention has an effect in that it includes a module array multi scanning control function enabling to display a high-definition image through a 4-way control for each of dot (RGB) pixels of the LED module to allow an image display dot of an LED module to be processed in a 4-way format by an automatic image switching device using the control of an image display for image switching by the SCU to enable various image displays so that an image quality with a sharper and higher resolution can be implemented and displayed irrespective of the display size of the electronic display board through the control of the pixel display dot of the LED module.

In addition, the electronic display board for controlling 4-way dual scanning in which a GSP is applied to a DICT according to an embodiment of the present invention has an effect in that a function of a general module driver, which displays an image on the electronic display board with a one-to-one (1:1) configuration between a display image of an LED module and a dot (RGB), is driven in the form of a dual scanning-based 4-way image display to form a 4-fold image dot pixel arrangement to display an image in such a manner that a dot pixel is arbitrarily arranged in a multi form by a driving display dot (RGB) so that the image can be displayed on the electronic display board through the module driver in a dual/multi 4-way format, and thus providing a maximum image display through a minimized dot pixel configuration.

Further, the electronic display board for controlling 4-way dual scanning in which a GSP is applied to a DICT according to an embodiment of the present invention has an effect in that it allows the GSP to be configured separately to enable to easily control an image in response to the signal OE (Out Enable) of the GSP within the MCU so that the resolution of the display of an ultra-high-definition image of the UHD level can be expressed easily, image data color (RGB) values of the module pixels can be controlled easily through the control of a gray scale color to enable to display a flicker-free image even in the case of a high-definition image, and the remote control of the GSP for the purpose of improving the performance can be performed even after installation of the electronic display board to enable to display a high-resolution and high-definition image of the UHD level unlike a conventional electronic display board structure in which a signal from an auto controller is directly applied to the SCU in response to a signal Out Enable Latch to display an image.

Besides, the electronic display board for controlling 4-way dual scanning in which a GSP is applied to a DICT according to an embodiment of the present invention has an effect in that an image display dot of an LED module is processed in a 4-way format by an automatic image switching device using the control of an image display for image switching by an SCU in response to a control signal for the pixel display of the LED module, thereby implementing and displaying an image quality with a sharper and higher resolution, and thus overcoming a limitation in the transmission speed of the display image and the display size of the electronic display board in an electronic display board display method when displaying an ultra-high-definition image of the UHD level on the electronic display board.

BEST MODE FOR CARRYING OUT THE INVENTION

Hereinafter, preferred embodiments of according to the present invention will be described in detail with reference to the accompanying drawings in order for a person of ordinary skill in the art to sufficiently understand and carry out the present invention. In the following description of the present invention, a detailed description of related known functions and configurations incorporated herein will be omitted, if necessary, when it may rather make the subject matter of the present invention unclear.

The present invention provides an electronic display board control technology which can display a high-definition image using a 4-way control for each image dot (RGB) pixel by enabling to apply a module array format of the electronic display board to a general LED module by means of the display control of the electronic display board, which can implement an image that is 4-fold sharper and brighter than that in the case of driving a general electronic display board through the driving control, the LED module arrangement, and the LED Dot(R,G,B) pixel-dependent process method to easily implement a high-definition image.

Figure 1:
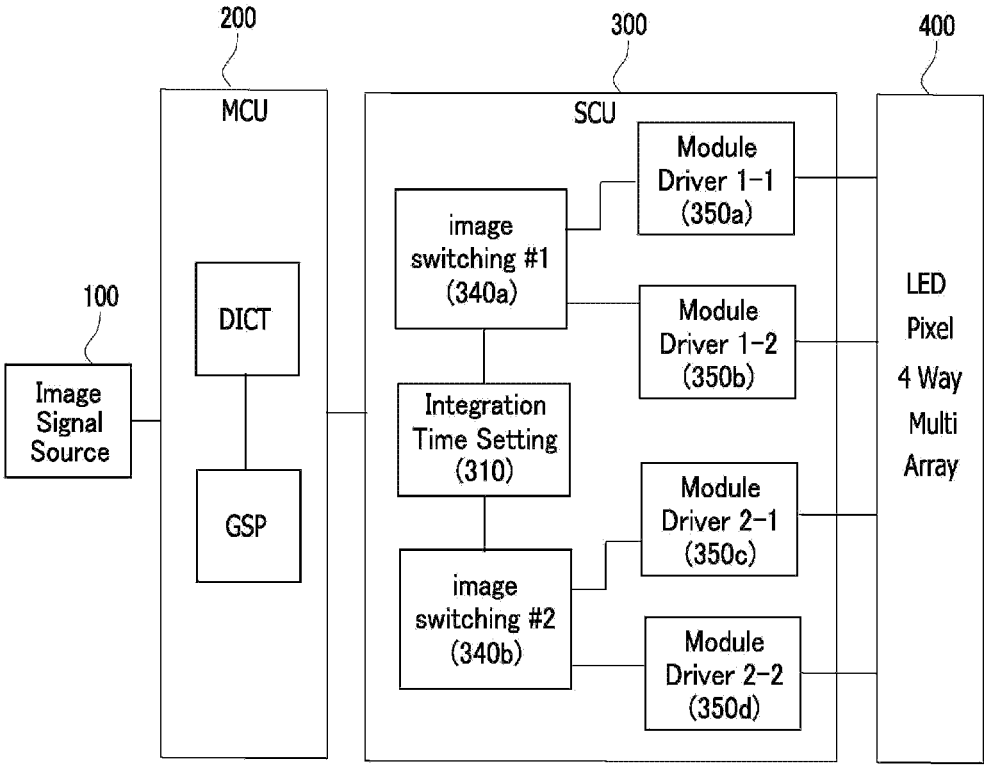
FIG. 1 is a block diagram showing a detailed configuration of an electronic display board for controlling 4-way dual scanning in which a GSP is applied to a DICT according to the present invention.

FIG. 1 is a block diagram showing a detailed configuration of an electronic display board for controlling 4-way dual scanning in which a GSP is applied to a DICT according to the present invention. The electronic display board for controlling 4-way dual scanning in which a GSP is applied to a DICT includes an image signal source 100, an MCU 200, an SCU 300, and an electronic display board module 400.

The image signal source 100 provides an image signal to the LED electronic display board module 400. The LED electronic display board module 400 is provided in the form of a Dot (R,G,B) pixel and receives the image signal from the image signal source 100 to display an image in such a manner that a dot pixel is arranged in a multi form by a driving display Dot (R,G,B). The image signal source 100 is a source for supplying an image signal to be displayed on the LED electronic display board module 400. For example, the image signal source 100 may be either a device that plays a video medium such as a DVD, an HDML, a DP or a VCR, or a computer that fetches image data stored in a memory and transmits the image data to the LED electronic display board module 400, but is not limited thereto.

The main control unit (MCU) 200 switches and displays, by dual scanning, an image in which an image data value with a gamma value determined on a histogram by a gamma controller 221 of an image processing DICT unit 220 including a gray scale processor (GSP) 230 has been gray-scaled by the GSP 230 to equalize and process the image through gamma correction of the image and the histogram of the brightness of the image, so that image data with no noise can be transmitted even under the control of image transmission for high-speed processing and thus image can be more stably displayed on the electronic display board even in the display of a high-definition image of the UHD level.

The MCU 200 includes a DCT control and a GSP function. The MCU 200 processes a DICT image for high-speed 4-way high-resolution transmission of the image data so that the image can be displayed on the electronic display board without any noises by controlling phenomena such as interruption of the image and distortion of the image quality occurring when transmitting a high-definition image signal according to a flicker phenomenon during the display of the image.

The MCU 200 enables a high-definition display even without any change in the data transmission speed or the number of image frames even in a high-definition driving state of the electronic display board through the implementation of the DICT and GSP functions for displaying the high-definition image with more sharpness under an environmental display change. In addition, the MCU 200 enables to easily display each of red, green and blue colors at 8 bits to 12 bits even in a general image in order to display RGB data ac even in an ultra-high-definition image of the UHD level according to 8 bits (256) to 10 bits (1024), and provides the GSP function so that calibration of the image display can be performed even in the maintenance process after installation.

The server control unit (SCU) 300 controls a signal designated by an integration time setting unit (ITS) 320 to be switched (340) to image data as image display data in response to the image data applied thereto after switching, by dual scanning, an image in which an image data value with the gamma value determined on the histogram by the image processing DICT unit 220 of the MCU 200 has been gray-scaled by the GSP 230 and controls the switched image data to be scanned onto pixel dots in a multi 4-way format (through the driving of a module driver 350) to display an image on an LED electronic display board module 400 so as to allow a high-definition image to be displayed on the electronic display board.

In other words, in the control of the image display of an electronic display board that is generally driven, a simple distribution transmission function is adopted in which the image data from the MCU 200 is directly transmitted to an LED electronic display board module 400. However, the electronic display board according to the present invention enables the SCU 300 to improve the quality of the display image to provide a high quality image through a reduction in flicker noise by a dot output value and a gray scale control value of an LED module of an image output section in response to the switched image data applied thereto from the GSP 230 so as to enhance the uniformity of White Balance, color, and brightness of an image which is displayed based on a dot output value and a gray scale pixel value of the LED module of the image output section.

The LED electronic display board module (400) is configured to form a screen by arranging, in a matrix form, a unit display module in which a plurality of LEDs are arranged for each of n×m dot (RGB) pixels in the form of a module array, and to allow the switched image data scanned onto pixel dots in response to an image signal inputted through an image input device to be displayed thereon in a multi 4-way format.

In addition, the LED electronic display board module 400 forms a screen by arranging, in a matrix form, a unit display module in which a plurality of LEDs are arranged for each of n×m pixels in the form of a module array, and displays image data generated by correcting brightness for image data inputted through real-time synthesis between an image data stream and a brightness correction data applied in consideration of the luminance of the pixel of the electronic display board or the brightness value in response to the image signal inputted through the image signal source.

Figure 2:
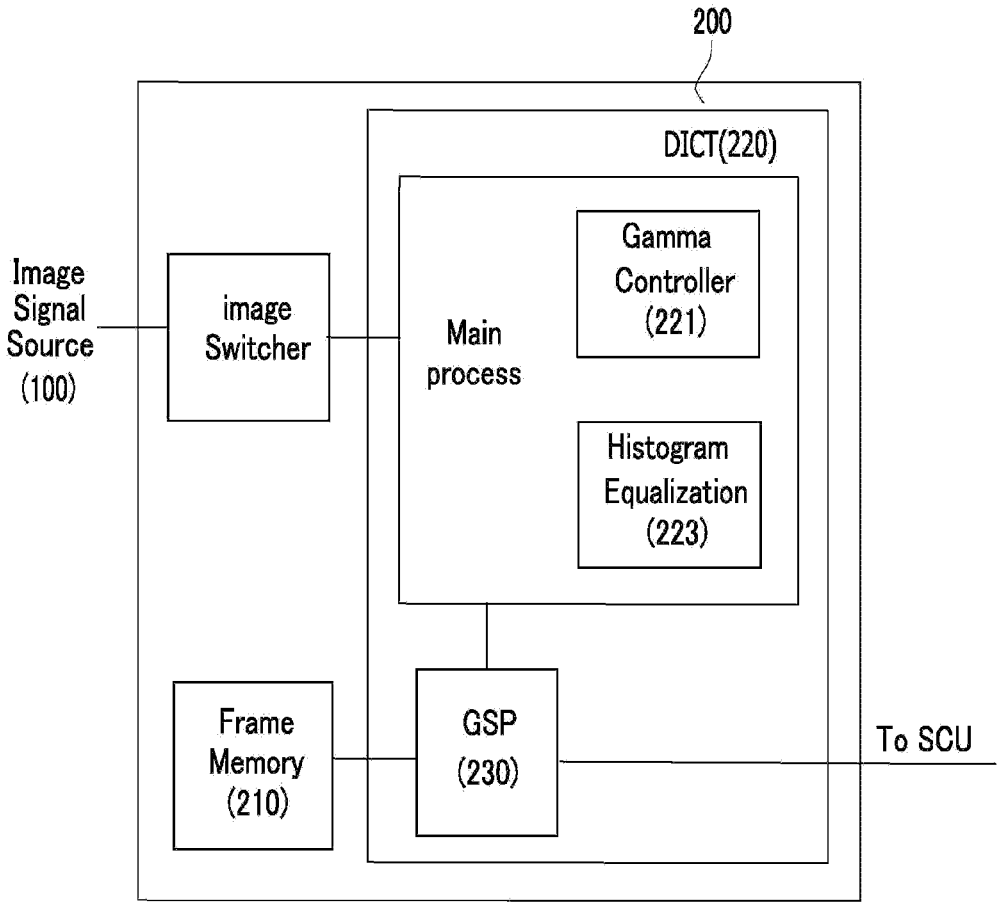
FIG. 2 is a block diagram showing an inner configuration of an MCU of FIG. 1.
Figure 3:
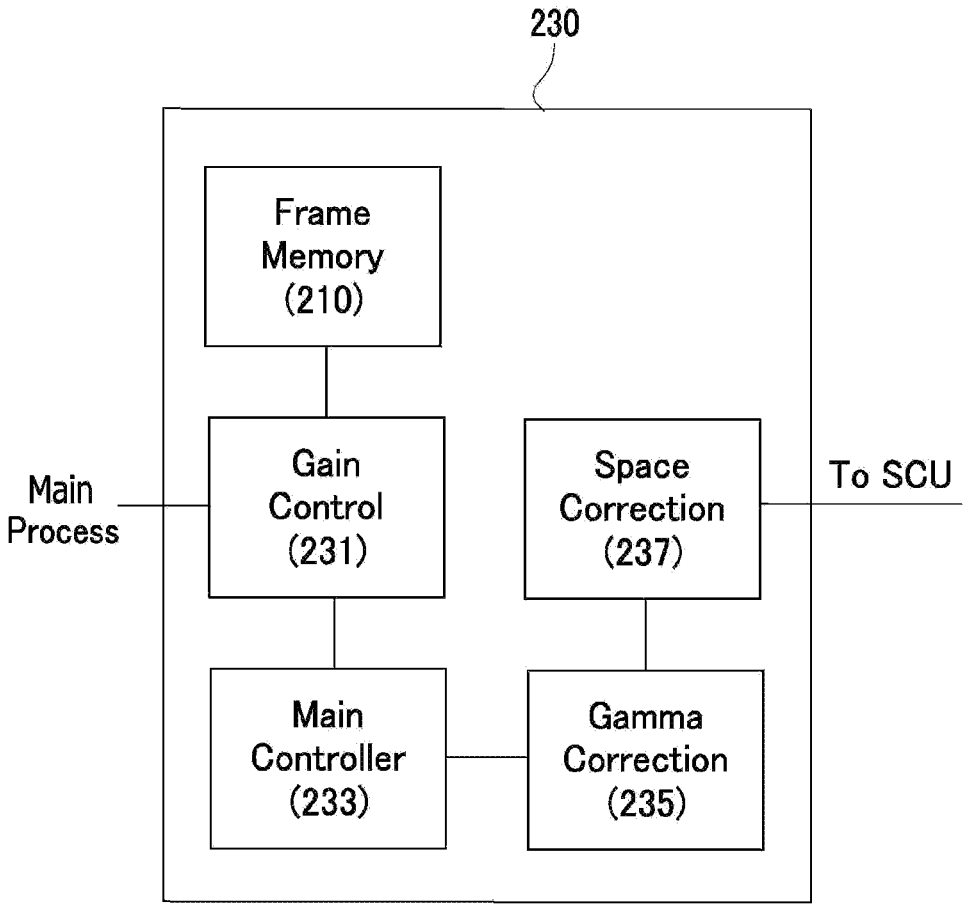
FIG. 3 is a block diagram showing an inner configuration of a GSP within an MCU of FIG. 1.
Figure 4:
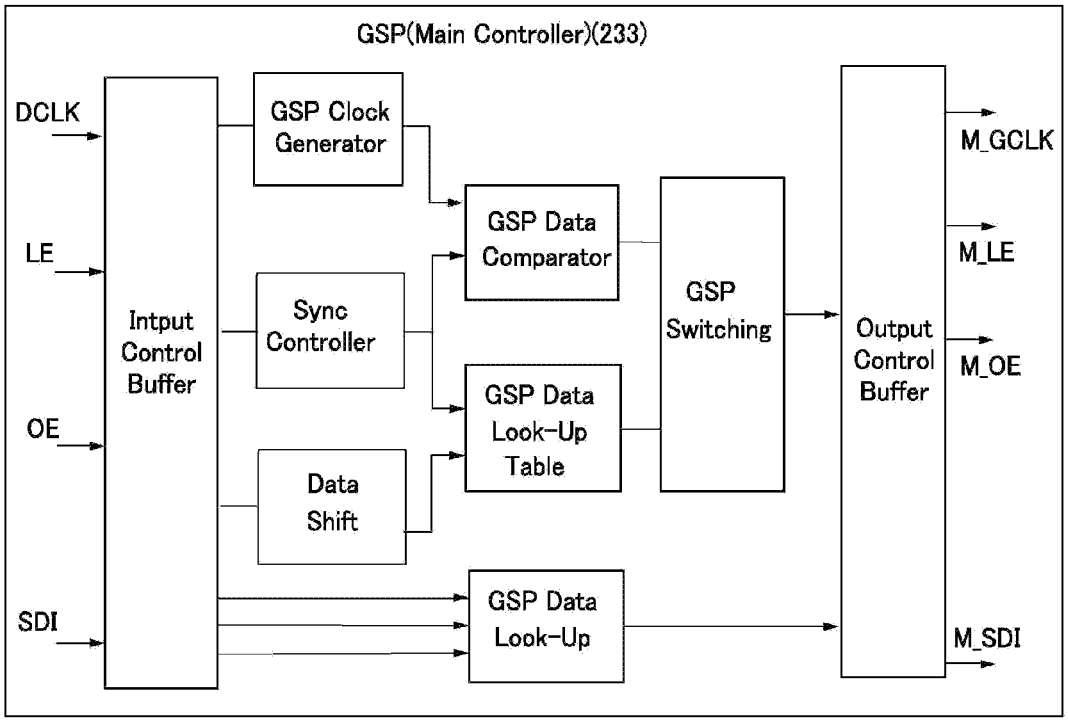
FIG. 4 is a block diagram showing an inner configuration of a main controller of a GSP within the MCU.

FIG. 2 is a block diagram showing an inner configuration of an MCU of FIG. 1, IG. 3 is a block diagram showing an inner configuration of a GSP within an MCU of FIG. 1, and FIG. 4 is a block diagram showing an inner configuration of a main controller of a GSP within the MCU. An operation of the MCU 200 will be described hereinafter with reference to FIGS. 1 to 4. The MCU 200 of the present invention is operated to be divided into the DICT 220 including a histogram equalizer 223 and the GSP 230. The main control unit (MCU) 200 switches and displays, by dual scanning, an image in which an image data value with a gamma value determined on a histogram by a gamma controller 221 of an image processing DICT unit 220 including a gray scale processor (GSP) 230 has been gray-scaled by the GSP 230 to equalize and process the image through gamma correction of the image and the histogram of the brightness of the image, so that image data with no noise can be transmitted even under the control of image transmission for high-speed processing and thus image can be more stably displayed on the electronic display board even in the display of a high-definition image of the UHD level.

The histogram equalizer 223 equalizes the image signal generated from the gamma controller 221 through synchronization and applied thereto by expressing, as a function, a ratio of the image signal to the number of pixels and uniformizing contrast value distribution to divide contrast values concentrated on one spot.

In addition, the gray scale processor (GSP) 230 includes a gain controller 231, a main controller 233, a gamma corrector 235, and a space corrector 237. The gray scale processor (GSP) 230 fetches and transmits relevant image data that is stored in a frame memory 210 when image information from the image signal source 100 is reproduced through an image switcher. In order to transmit the relevant image data, a gain controller 231 controls a frame frequency of an output image by converting a low-level gray scale into a high-level gray scale through the adjustment of a refresh rate with respect to the kind of information on an input image stored in the frame memory 210 in a frame unit.

The main controller 233 reads RGB (Red, Green and Blue) image data outputted from the frame memory having data stored therein in response to a memory read signal controlled by signals CLK and LATCH, and controls the data read from the memory to be stored in a shift register of an LED constant current drive IC and controls the image data to be outputted to LEDs by color depending on each data when an output control signal OE (Out Enable) is asserted.

More specifically, the main controller 233 generates signals SHIFT CLOCK and LATCH necessary for displaying a high quality image based on a dot output value and a gray scale control value of an LED module of an image output section, and increases a refresh rate without any direct increase in a clock rate of Read/Write Timing of the frame memory so that Timing Control is controlled by the OE (Out Enable) signal of the constant current drive IC to output an image without any influence of Read/Write Timing of the frame memory. The main controller 233 reads RGB (Red, Green and Blue) image data outputted from the frame memory having data stored therein in response to a memory read signal controlled by signals CLK and LATCH. The data read from the memory is stored in a shift register of an LED constant current drive IC and the image data is outputted to LEDs by color depending on each data when an output control signal OE(Out Enable) is asserted.

The gamma corrector (235) controls brightness correction so as to enhance the uniformity of White Balance, color, and brightness of an image which is displayed based on a dot output value and a gray scale pixel value of the LED module. In other words, the gamma corrector 235 converts the image into a gray scale bit source image signal of a target value with respect to the controlled refresh rate according to a gray scale adjusted through the gain controller (231) and generates a gray scale clock suitable for a gray scale bit conversion logic and a control and synchronization signal of a horizontal synchronization signal and a data clock for transmission to control brightness correction so as to enhance the uniformity of White Balance, color, and brightness of an image which is displayed based on a dot output value and a gray scale pixel value of the LED module.

The space corrector 237 generate the gray scale clock suitable for a gray scale bit conversion logic and the control and synchronization signal of the horizontal synchronization signal and the data clock for transmission.

Conventionally, the MCU 200 is configured to directly apply a signal from an auto controller to the SCU 300 in response to a signal Out Enable Latch to display an image. However, the present invention allows the GSP 230 to be configured separately to enable to easily control an image in response to the signal OE (Out Enable) of the GSP 230 within the MCU 200 so that the resolution of the display of an ultra-high-definition image of the UHD level can be expressed easily, image data color (RGB) values of the module pixels can be controlled easily through the control of a gray scale color to enable to display a flicker-free image even in the case of a high-definition image, and the remote control of the GSP for the purpose of improving the performance can be performed even after installation of the electronic display board to enable to display a high-resolution and high-definition image of the UHD level.

Figure 5:
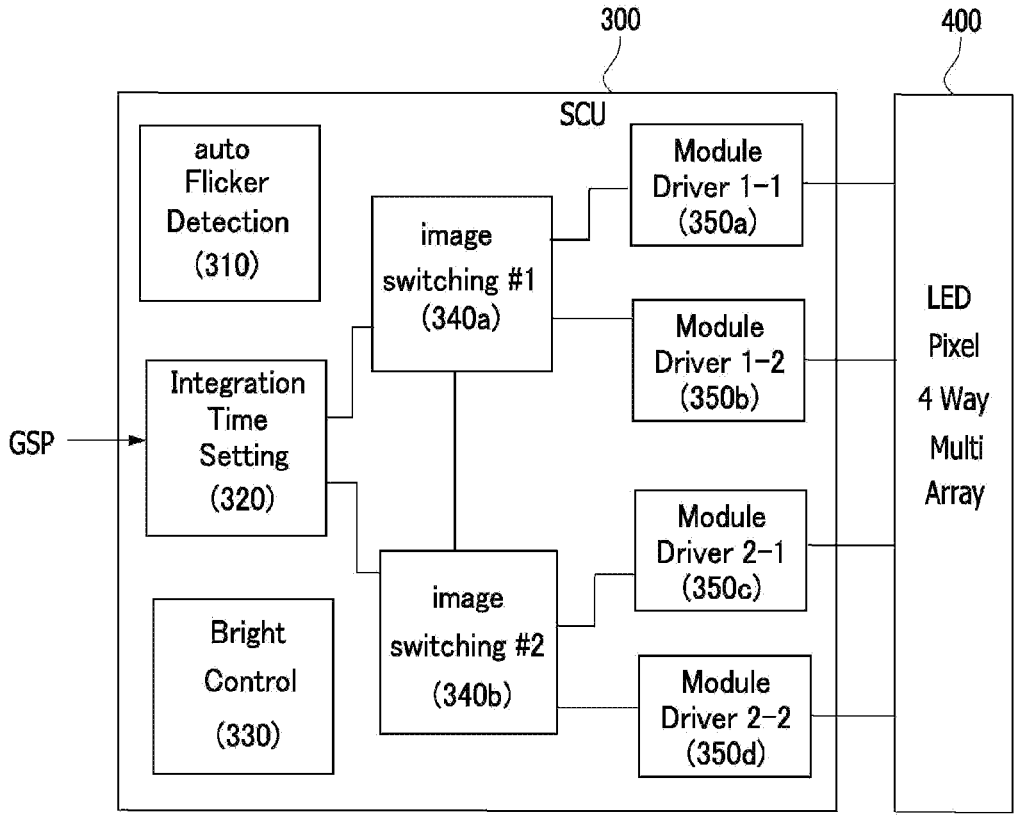
FIG. 5 is a block diagram showing an inner configuration of an SCU of FIG. 1.
Figure 6:
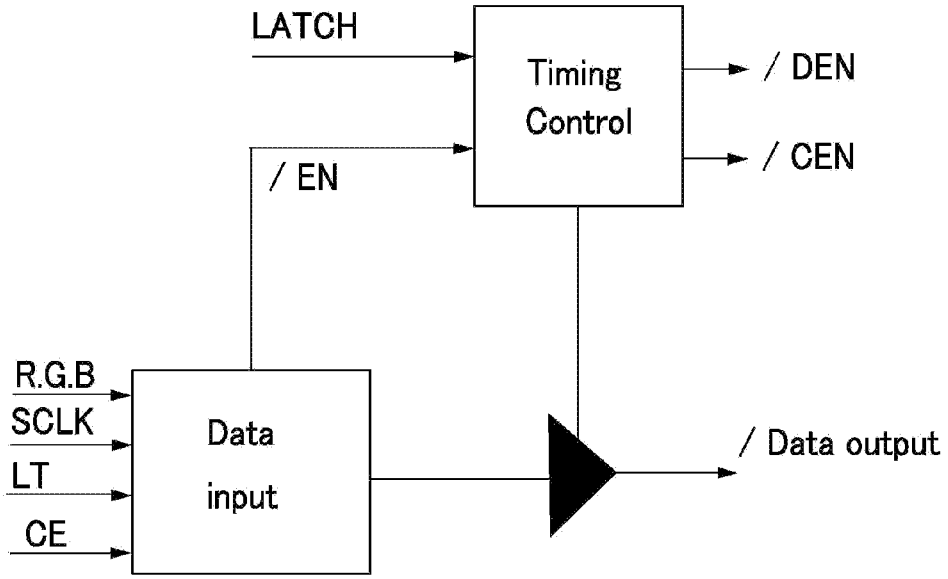
FIG. 6 is a circuit diagram showing an inner configuration of an ITS within an SCU of FIG. 1.

FIG. 5 is a block diagram showing an inner configuration of an SCU of FIG. 1, and FIG. 6 is a circuit diagram showing an inner configuration of an integration time setting unit (ITS) within an SCU of FIG. 1. The SCU 300 is largely divided into an auto flicker detection unit 310, an integration time setting unit 320, and an image switching unit 340. The auto flicker detection unit 310 generates a flicker-free image by setting a frame frequency of an output image by converting a low-level gray scale into a high-level gray scale through the adjustment of a refresh rate in order to improves the quality of the display image to provide a high quality image through a reduction in flicker noise by a dot output value and a gray scale control value of an LED module of an image output section in response to the switched image data applied thereto by the driving of the main controller 233 of the GSP 230.

The integration time setting unit (ITC) 320 identifies whether an integration time is an integer multiple of an input period to detect a flick frequency and control the integration time with respect to the flicker-free image generated from the auto flicker detection unit (310), and transmits a relevant image signal to the LED electronic display board module in consideration of the transmitted setting period time so as to be displayed.

In other words, the SCU 300 improves the quality of the display image to provide a high quality image through a reduction in flicker noise by a dot output value and a gray scale control value of an LED module of an image output section in response to the switched image data applied thereto from the GSP 230 so as to enhance the uniformity of White Balance, color, and brightness of an image which is displayed based on a dot output value and a gray scale pixel value of the LED module of the image output section.

The image switching unit 340 performs a switching function of switching a signal designated by the ITS 320 to image data as image display data to allow an image to be displayed on the electronic display board and allows the switched image data to be scanned onto pixel dots in a multi 4-way format so that a high-definition image is displayed on the electronic display board through the module driver 350.

Figure 7:
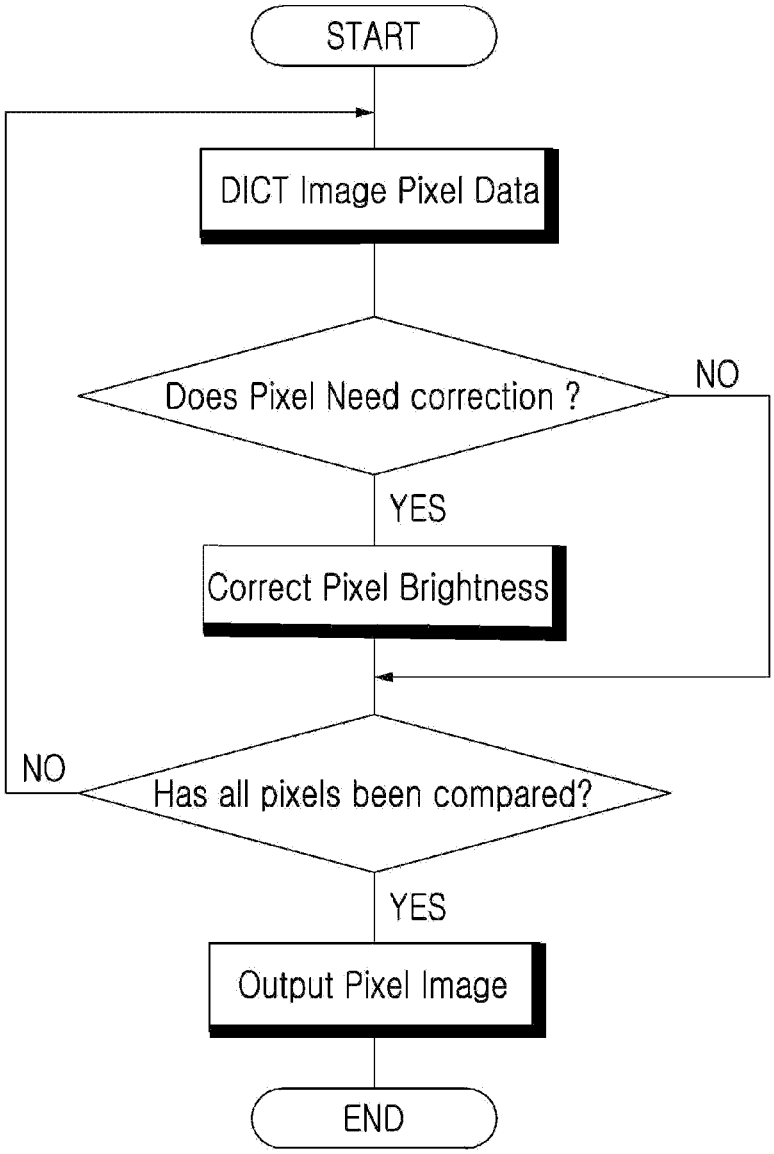
FIG. 7 is a flowchart showing a driving process of an electronic display board for controlling 4-way dual scanning in which a GSP is applied to a DICT according to the present invention.

FIG. 7 is a flowchart showing a driving process of an electronic display board for controlling 4-way dual scanning in which a GSP is applied to a DICT according to the present invention. The driving process of an electronic display board will be described hereinafter. First, the image processing DICT 220 processes an image for the purpose of a high-resolution transmission in response to an image signal inputted through the image signal source to process a relevant data to fit pixels of the LED module 400 to prevent a flicker phenomenon and a noise from occurring during the display of the image, and the GSP 230 identifies whether to correct a relevant pixel based on a gamma value determined on the histogram for the image switching with respect to the processed pixel data.

In this case, if any correction is necessary, the GSP 230 corrects an image for the relevant pixel to allow a gray-scaled image to be scanned by dual scanning so as to be displayed.

Subsequently, the GSP 230 compares all pixels to allow an image to be displayed on the LED electronic display board module 400 with respect to the corrected or inputted image data, and then outputs a pixel image to the SCU 300 to allow the pixel image to be displayed as a unit pixel of the LED electronic display board module through the image switching unit 340.

THE DESCRIPTION OF REFERENCE NUMERALS OF THE MAIN ELEMENTS IN DRAWINGS

100: image signal source
200: SCU
210: frame memory
220: DICT
221: gamma controller
223: histogram equalizer
230: GSP
231: gain controller
233: main controller
237: space corrector
239: gamma corrector
300: SCU
320: auto flicker detection unit
310: integration time setting unit
330: bright control unit
340: image switching unit
350: module driver
400: LED electronic display board Module

The invention claimed is:

1. An electronic display board for controlling 4-way dual scanning in which a GSP is applied to a DICT, comprising:

an image signal source (100) that is a source for supplying an image signal to be displayed on an LED electronic display board module (400), the image signal source being configured to play a video medium such as a DVD, an HDML, a DP or a VCR or fetch image data stored in a memory and transmit the image data to the LED electronic display board module (400);

an main control unit (MCU) (200) configured to switch and display, by dual scanning, an image in which an image data value with a gamma value determined on a histogram by a gamma controller (221) of an image processing DICT unit (220) including a gray scale processor (GSP) (230) has been gray-scaled by the GSP (230) for the purpose of 4-way high-resolution transmission of input image data of the image signal source (100) to enable a high-definition display without any change in the data transmission speed or the number of image frames and equalize and process the image through gamma correction of the image and the histogram of the brightness of the image, so that image data with no noise can be provided by controlling phenomena such as interruption of the image and distortion of the image quality occurring when transmitting a high-definition image signal according to a flicker phenomenon during the display of the image, and thus the image can be displayed on the electronic display board without any noises;

a server control unit (SCU) (300) configured to control an auto flicker detection unit (310) to generate a display image through a reduction in flicker noise by a dot output value and a gray scale control value of an LED module of an image output section, to control a signal designated by an integration time setting unit (ITS) (320) to be switched (340) to image data as image display data in response to the image data applied thereto after switching, by dual scanning, an image in which an image data value with the gamma value determined on the histogram by the image processing DICT unit (220) of the MCU 200 has been gray-scaled by the GSP (230), and to control the switched image data to be scanned onto pixel dots in a multi 4-way format through the driving of a module driver (350) to display an image on an LED electronic display board module (400) so as to allow a high-definition image to be displayed on the electronic display board;

an LED electronic display board module (400) configured to form a screen by arranging, in a matrix form, a unit display module in which a plurality of LEDs are arranged for each of n×m dot (RGB) pixels in the form of a module array, and to allow the switched image data scanned onto pixel dots through the driving of a module driver (350) in response to the image signal inputted through the image signal source to be displayed thereon in a multi 4-way format.

2. The electronic display board according to claim 1, wherein the main control unit (200) comprises a histogram equalizer (223) configured to equalize the image signal generated from the gamma controller (221) through synchronization and applied thereto by expressing, as a function, a ratio of the image signal to the number of pixels and making contrast value distribution uniform to divide contrast values concentrated on one spot, wherein the gray scale processor (GSP) (230) fetches and transmits relevant image data that is stored in a frame memory (210) when image information from the image signal source (100) is reproduced through an image switcher, and wherein the gray scale processor (GSP) (230) comprises:

a gain controller (231) configured to control a frame frequency of an output image by converting a low-level gray scale into a high-level gray scale through the adjustment of a refresh rate with respect to the kind of information on an input image stored in the frame memory (210) in a frame unit in order to transmit the relevant image data;

a main controller (223) configured to read RGB (Red, Green and Blue) image data outputted from the frame memory having data stored therein in response to a memory read signal controlled by signals CLK and LATCH, and to control the data read from the memory to be stored in a shift register of an LED constant current drive IC and to control the image data to be outputted to LEDs by color depending on each data when an output control signal OE (Out Enable) is asserted;

a gamma corrector (235) configured to convert the image into a gray scale bit source image signal of a target value with respect to the controlled refresh rate according to a gray scale adjusted through the gain controller (231) and generate a gray scale clock suitable for a gray scale bit conversion logic and a control and synchronization signal of a horizontal synchronization signal and a data clock for transmission to control brightness correction so as to enhance the uniformity of White Balance, color, and brightness of an image which is displayed based on a dot output value and a gray scale pixel value of the LED module; and a space corrector (237) configured to generate the gray scale clock suitable for a gray scale bit conversion logic and the control and synchronization signal of the horizontal synchronization signal and the data clock for transmission.

3. The electronic display board according to claim 1, wherein the SCU (300) comprises:

an auto flicker detection unit (310) configured to generate a flicker-free image by setting a frame frequency of an output image by converting a low-level gray scale into a high-level gray scale through the adjustment of a refresh rate in order to improves the quality of the display image to provide a high quality image through a reduction in flicker noise by a dot output value and a gray scale control value of an LED module of an image output section in response to the switched image data applied thereto by the driving of the main controller (233) of the GSP (230);

the integration time setting unit (ITC) (320) configured to identify whether an integration time is an integer multiple of an input period to detect a flick frequency and control the integration time with respect to the flicker-free image generated from the auto flicker detection unit (310), and transmit a relevant image signal to the LED electronic display board module in consideration of the transmitted setting period time so as to be displayed; and an image switching unit (340) configured to perform a switching function of switching a signal designated by the ITS (320) to image data as image display data to allow an image to be displayed on the electronic display board, and allow the switched image data to be scanned onto pixel dots in a multi 4-way format so that a high-definition image is displayed on the electronic display board through the module driver (350).

* * * * *